US006668797B2

(12) United States Patent
Smith

(10) Patent No.: US 6,668,797 B2
(45) Date of Patent: Dec. 30, 2003

(54) FUEL INJECTION PUMP SYSTEM

(75) Inventor: Steven R. Smith, Riverside, CA (US)

(73) Assignee: Advanced Vehicle Technologies, Riverside, CA (US)

( * ) Notice: Subject to any disclaimer, the term of this patent is extended or adjusted under 35 U.S.C. 154(b) by 66 days.

(21) Appl. No.: 10/145,975

(22) Filed: May 13, 2002

(65) Prior Publication Data

US 2003/0209226 A1 Nov. 13, 2003

(51) Int. Cl.[7] ..... F04B 17/00; F02D 31/00
(52) U.S. Cl. ..... 123/364; 417/372
(58) Field of Search ..... 123/364, 495, 123/472; 417/372, 490

(56) References Cited

U.S. PATENT DOCUMENTS 2,357,870 A * 9/1944 Beeh ..... 417/372
2,440,194 A * 4/1948 Juhasz ..... 417/372
4,656,980 A * 4/1987 Ohkoshi ..... 123/365
4,697,565 A * 10/1987 Kobayashi et al. ..... 417/372
5,146,895 A * 9/1992 Fehlmann et al. ..... 417/372
5,207,201 A * 5/1993 Schlagmuller et al. ..... 123/447
5,460,132 A * 10/1995 Ishiwata et al. ..... 123/364
5,795,140 A * 8/1998 Jin ..... 417/372
6,032,875 A 3/2000 Grimshaw-Jones ..... 239/106
6,238,190 B1 5/2001 Czarnecki ..... 417/297
6,247,450 B1 6/2001 Jiang ..... 123/446

* cited by examiner

*Primary Examiner*—Thomas N. Moulis
(74) *Attorney, Agent, or Firm*—Michael S. Neustel

(57) ABSTRACT

A fuel injection pump system specifically designed to provide a variety of fuels, including aviation kerosene-jet fuel, arctic fuels and diesel fuels to a single cylinder compression ignited engine using a single bore fuel injection pump and governor in a single housing. The fuel injection pump system includes a housing enclosing a fuel injection pump with governor system which is attached directly to the engine casing. thereby using the engine's oil for lubrication of the fuel injection pump. The internally attached governor system enables the engine to idle smoothly at a predetermined speed and also provide high-speed protection by reducing fuel at predetermined RPM settings. A uniquely designed plunger and barrel in the fuel injection pump incorporates an anti-knock helix shaped plunger that changes the idle injection timing for sound attenuation.

16 Claims, 11 Drawing Sheets

FUEL INJECTION PUMP SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to fuel injection pump systems and more specifically it relates to a fuel injection pump system for providing a variety of fuels, including aviation kerosene-jet fuel, arctic fuels and diesel fuels, to a compression ignited engine.

2. Description of the Related Art

Fuel injection pump devices have been in use for years. Typical fuel injection pump devices are stand-alone systems, mechanically or electrically controlled that deliver fuel to an internal combustion engine. The pump often includes a plunger that reciprocates in a barrel bore to pressurize the fuel. Such systems include a means for controlling the fuel delivery.

Lubrication of a fuel injection pump using aviation kerosene-jet fuel, arctic fuel or diesel fuel can be a significant problem as these fuels are dryer and less viscous than most fuels. Fuel injection pumps are normally designed to handle one type of fuel and therefore are limited in their application.

Current systems do not incorporate a governor internal to the system to enable the engine to idle smoothly at predetermined speeds nor are fuel systems typically designed with an internal governor to assist the engine by reducing fuel flow at high engine revolutions per minute (RPMs).

Examples of patented devices which are related to the present invention include U.S. Pat. No. 6,247,450 to Jiang; U.S. Pat. No. 6,238,190 to Czarnecki; and U.S. Pat. No. 6,032,875 to Grimshaw-Jones.

While these devices may be suitable for the particular purpose to which they address, they are not as suitable for providing a variety of fuels to a single cylinder compression ignited engine using a single bore fuel injection pump and governor in a single housing.

In these respects, the fuel injection pump system according to the present invention substantially departs from the conventional concepts and designs of the prior art, and in so doing provides an apparatus primarily developed for the purpose of working with a variety of different fuels in a single cylinder compression ignited engine using a single bore fuel injection pump and governor in a single housing.

BRIEF SUMMARY OF THE INVENTION

In view of the foregoing disadvantages inherent in the known types of fuel injection pump systems now present in the prior art, the present invention provides a new fuel injection pump system construction wherein the same can be utilized for providing a variety of fuels to a single cylinder compression ignited engine using a single bore fuel injection pump and governor in a single housing.

The general purpose of the present invention, which will be described subsequently in greater detail, is to provide a new fuel injection pump system that has many of the advantages of the fuel injection pump systems mentioned heretofore and many novel features that result in a new fuel injection pump system which is not anticipated, rendered obvious, suggested, or even implied by any of the prior art fuel injection pump systems, either alone or in any combination thereof.

To attain this, the present invention generally comprises a housing enclosing a fuel injection pump with governor system which is attached directly to the engine casing thereby using the engine's oil and compression for lubrication of the fuel injection pump. The internally attached governor system enables the engine to idle smoothly at a predetermined speed and also provide high-speed protection by reducing fuel at predetermined RPM settings. A uniquely designed plunger and barrel in the fuel injection pump incorporates an anti-knock helix-shaped plunger that changes the idle injection timing for sound attenuation.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a fuel injection pump system that will overcome the shortcomings of the prior art devices.

A second object is to provide a fuel injection pump system for providing a variety of fuels, including aviation kerosene-jet fuel, arctic fuels and diesel fuels, to a single cylinder compression ignited engine using a single bore fuel injection pump and governor in a single housing.

Another object is to provide a fuel injection pump system that is adequately lubricated under various RPM conditions.

An additional object is to provide a fuel injection pump system that is adequately lubricated when using a variety of fuels.

A further object is to provide for smoother engine operation by utilizing a fuel injection pump system that rotates counterclockwise.

Another object is to provide a fuel injection pump system that is compact in structure.

An additional object is to provide a fuel injection pump system that can use a variety of fuels interchangeably.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
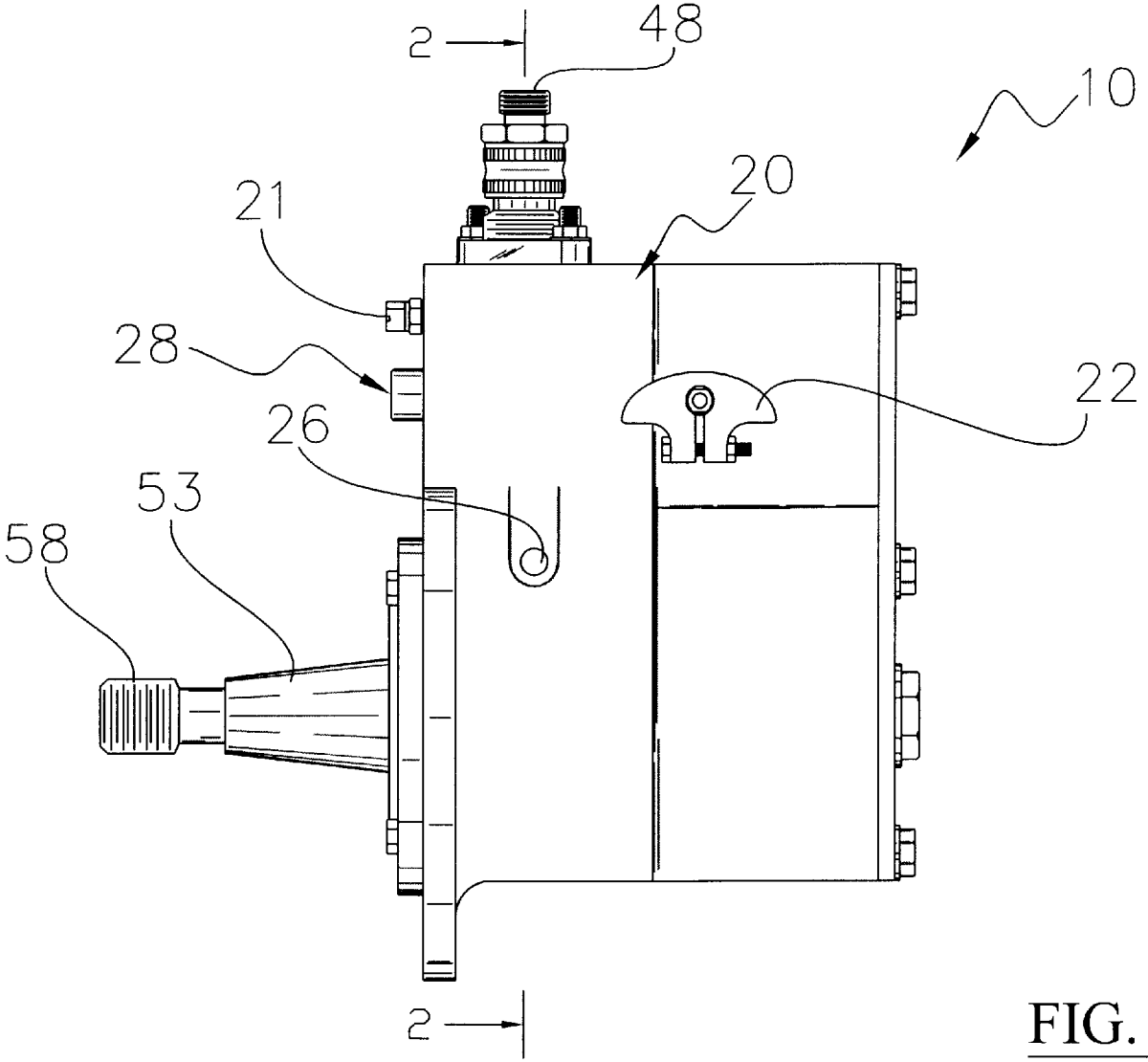
FIG. 1 is a side view of the present invention.

Turning now descriptively to the drawings, in which similar reference characters denote similar elements throughout the several views, FIGS. 1 through 11 illustrate a fuel injection pump system 10, which comprises a housing 20 containing a counterclockwise cam-driven plunger 36 and mechanical governor 60. The housing 20 for the fuel injection pump system 10 includes a mating flange 29 which correspondingly attaches to the engine housing 70. This mounting arrangement provides for engine oil distribution to be accomplished by taking advantage of crankcase oil pressure.

Figure 2:
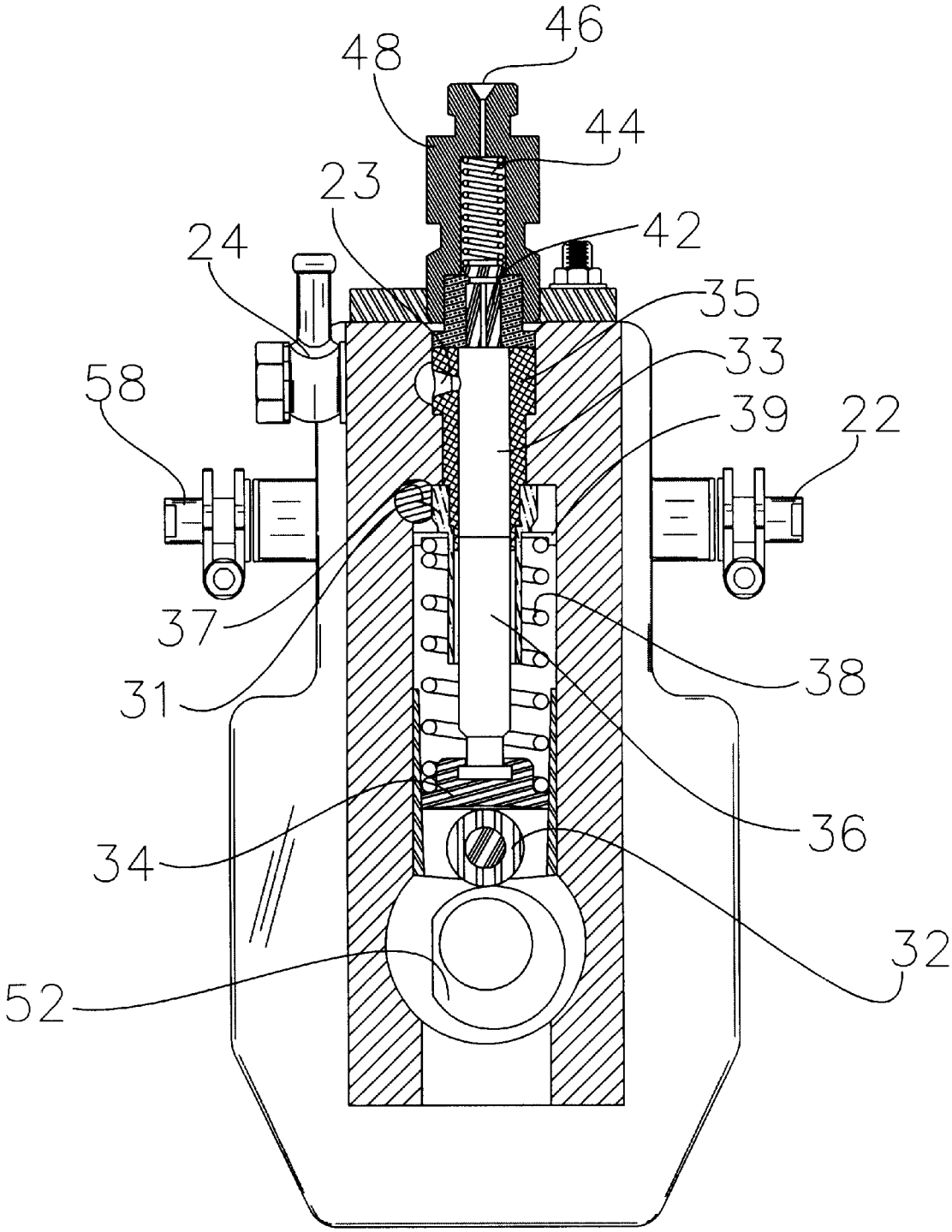
FIG. 2 is a sectional view of the present invention along line 2—2 of FIG. 1.
Figure 3:
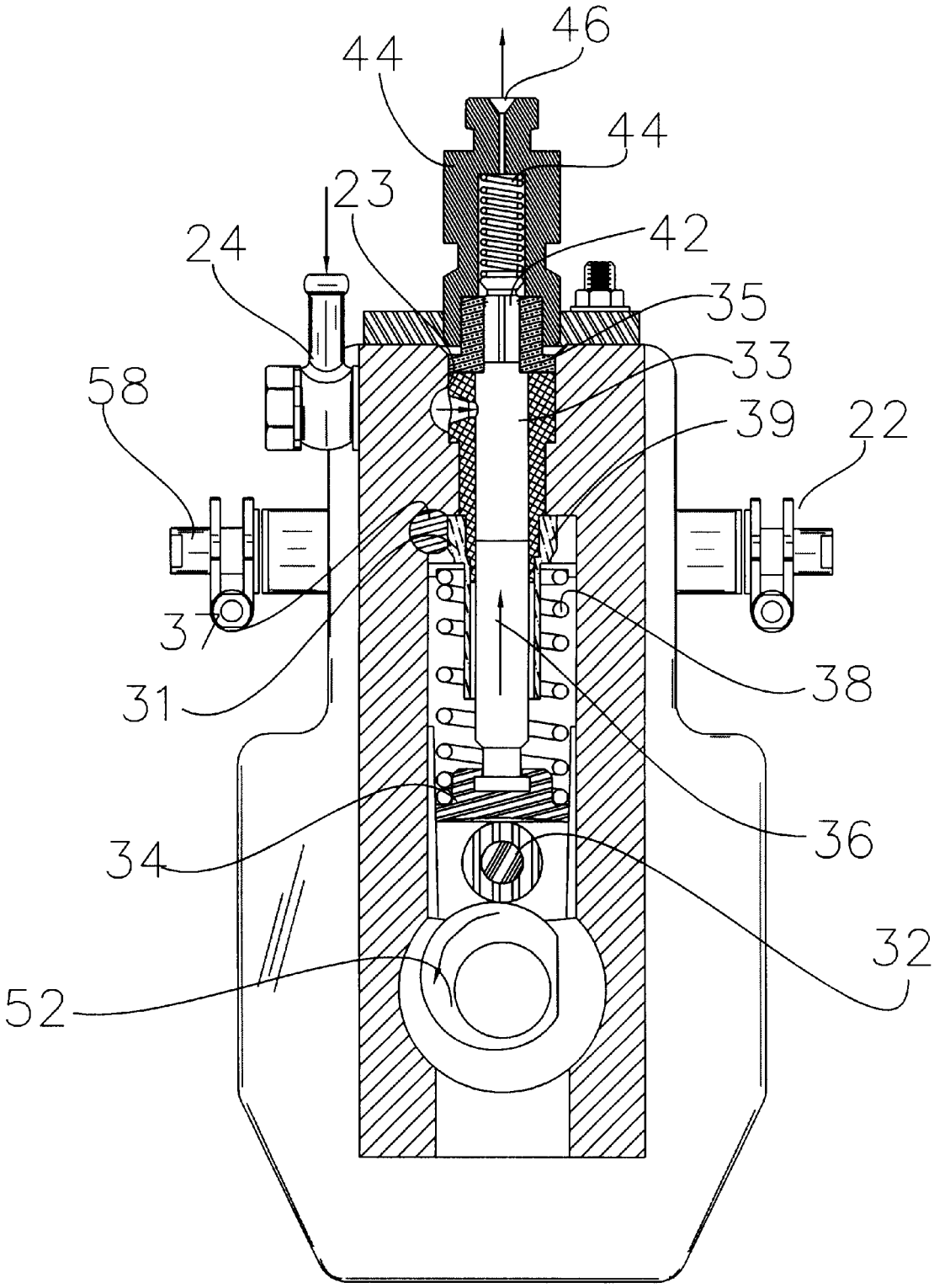
FIG. 3 is a sectional view of the present invention along line 2—2 of FIG. 1 indicating fuel flow direction and cam lobe rotation.
Figure 4:
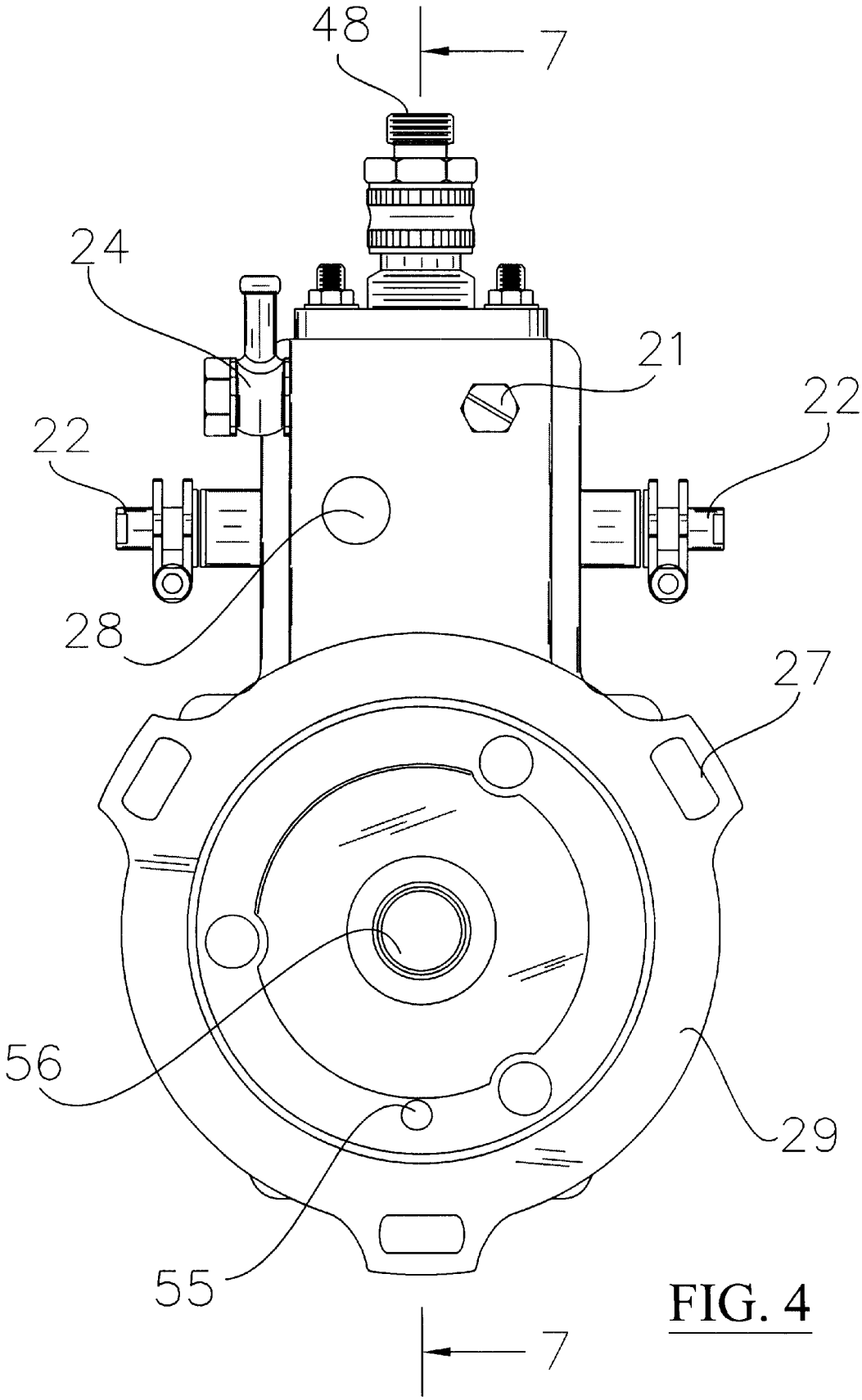
FIG. 4 is a front view of the present invention.

As best seen in FIG. 2, the plunger assembly 30 includes a cam lobe 52 which is in rotational contact with the tappet 32. The tappet 32 is in physical contact with the first spring seat 34 as shown in FIG. 2. The first spring seat 34 is attached to the drive end of the plunger 36. The second end of the plunger 36 is helically shaped. The first spring seat 34 is held in position against the tappet 32 by a spring 38 positioned between the first spring seat 34 and the second spring seat 39. The plunger 36 is positioned and can axially slide within the barrel bore sleeve 35. The side wall of barrel bore sleeve 35 includes an opening 23 which is in fluid connection with the fuel inlet 24. A pinion sleeve 31 is in contact with the plunger 36 to rotationally turn the plunger 36 to meter fuel. The pinion sleeve 31 is controlled by the fuel delivery control rack 37 in a conventional manner.

A mechanical governor 60 is housed internally to the fuel injection pump system 10 and is connected to the fuel delivery control rack 37. In addition, a throttle assembly 22 is connected to the fuel delivery control rack 37.

Figure 9:
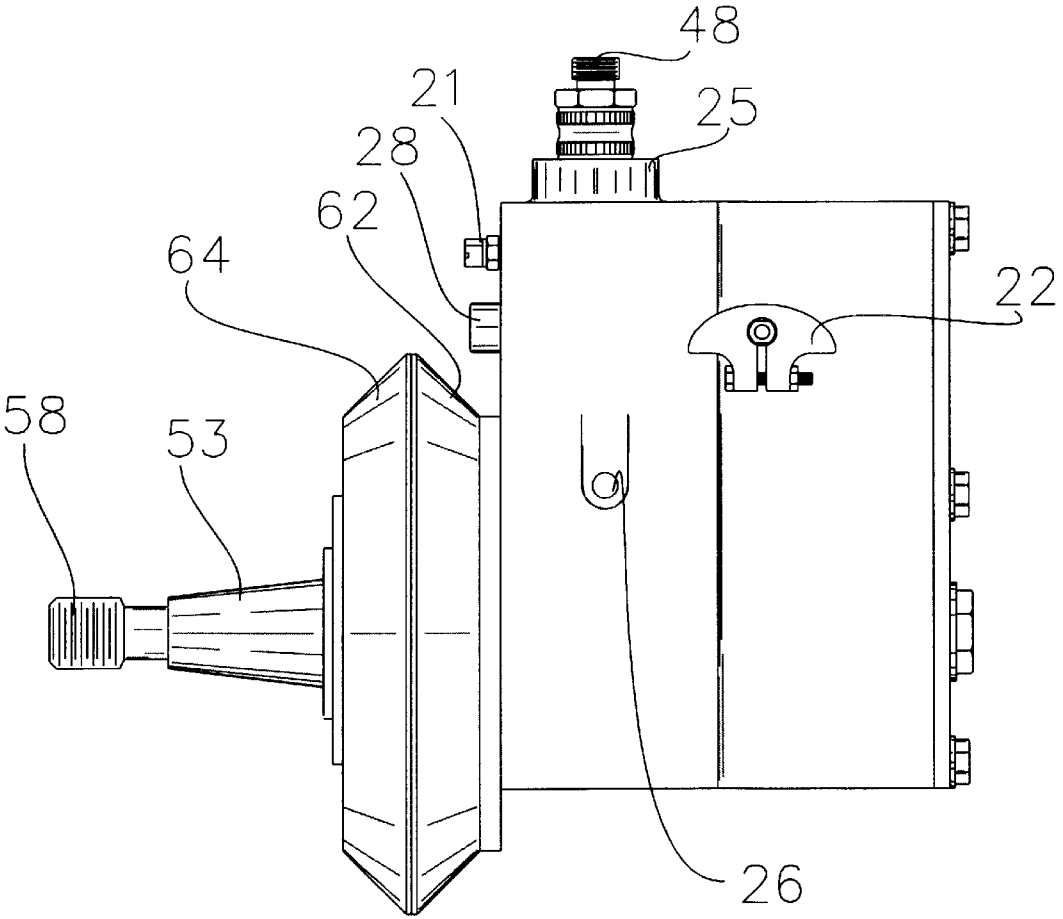
FIG. 9 is a side view of a second embodiment of the present invention.
Figure 10:
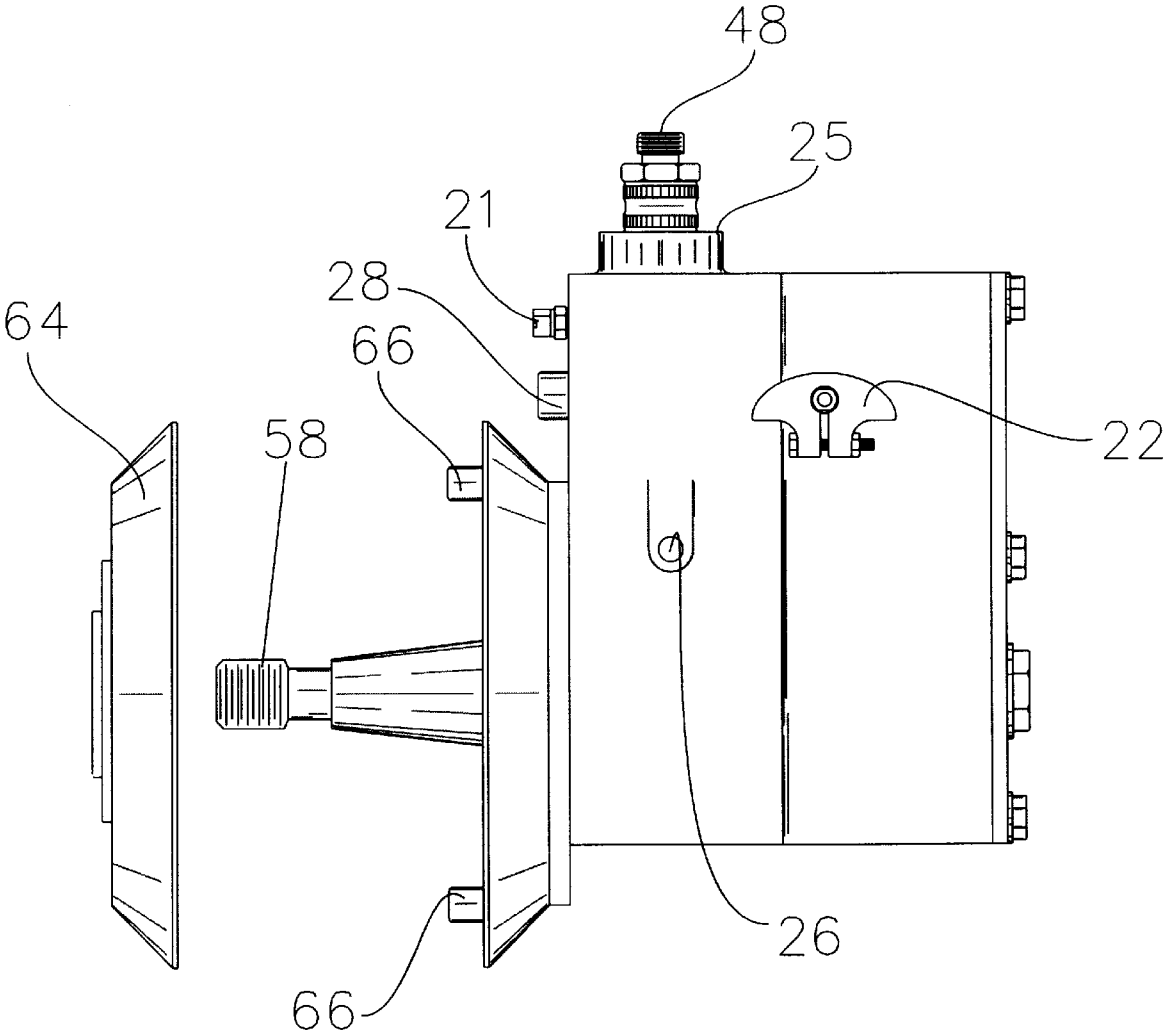
FIG. 10 is an exploded side view of the second embodiment of the present invention.

A retraction delivery valve 42 is positioned axially opposite the plunger 36 in the barrel bore 33. The retraction delivery valve 42 moves axially in relation to the opening 46 of the fuel injection system 10 and is biased towards the closed position by a second spring 44. The delivery valve assembly 40 is maintained in position on the fuel injection pump system 10 by the valve assembly holder 48. As shown in FIGS. 9 and 10 an alternate housing may include a receivable flange 25 to accept a threaded delivery valve assembly 40. However, it can be appreciated by one skilled in the art that the delivery valve assembly 40 may be attached to a housing 20 using a variety of different methods.

The housing 20 to the fuel injection pump system 10 includes connections to the fuel inlet 24, the throttle assembly 22, a fuel bleed off screw 21, an oil inlet 26, and a rack cap 28. The housing 20 includes a mounting flange 29 which allows the fuel injection pump system 10 to be connected to the engine housing 70.

Figure 5:
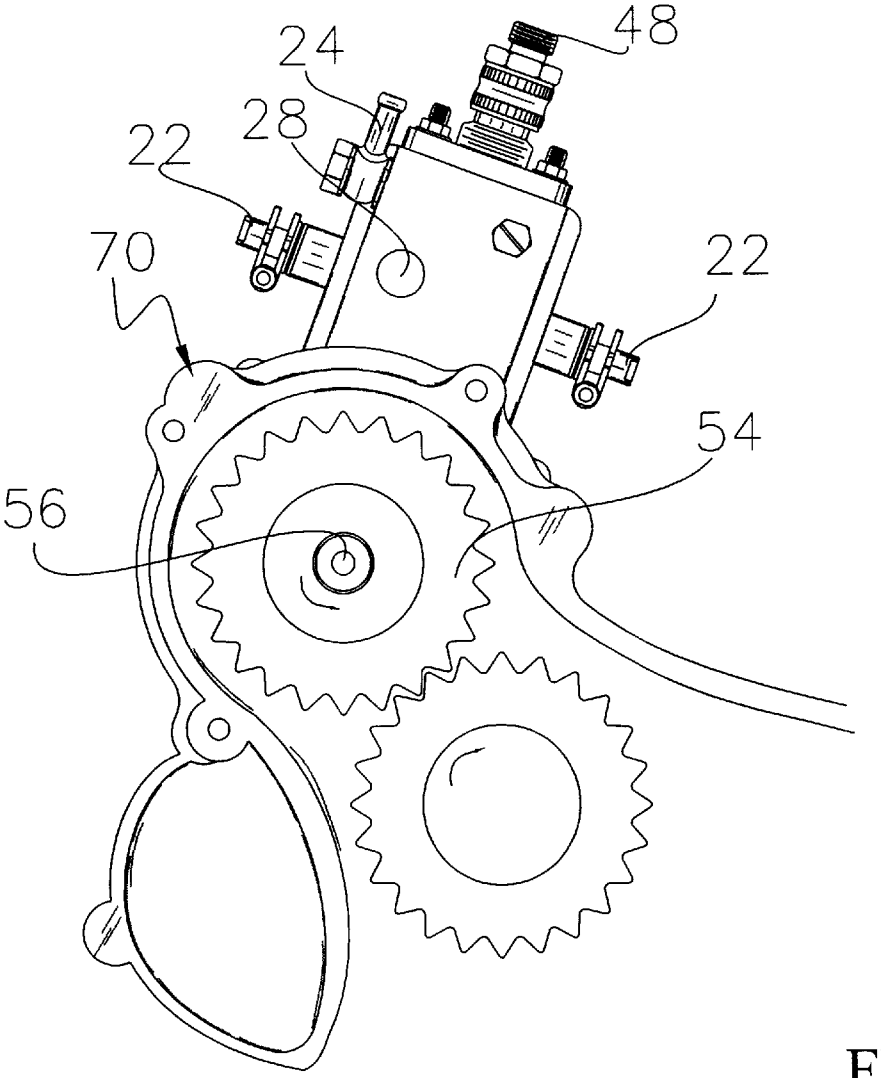
FIG. 5 is a side view of the present invention mounted to an engine housing indicating the counterclockwise rotation of the camshaft.
Figure 6:
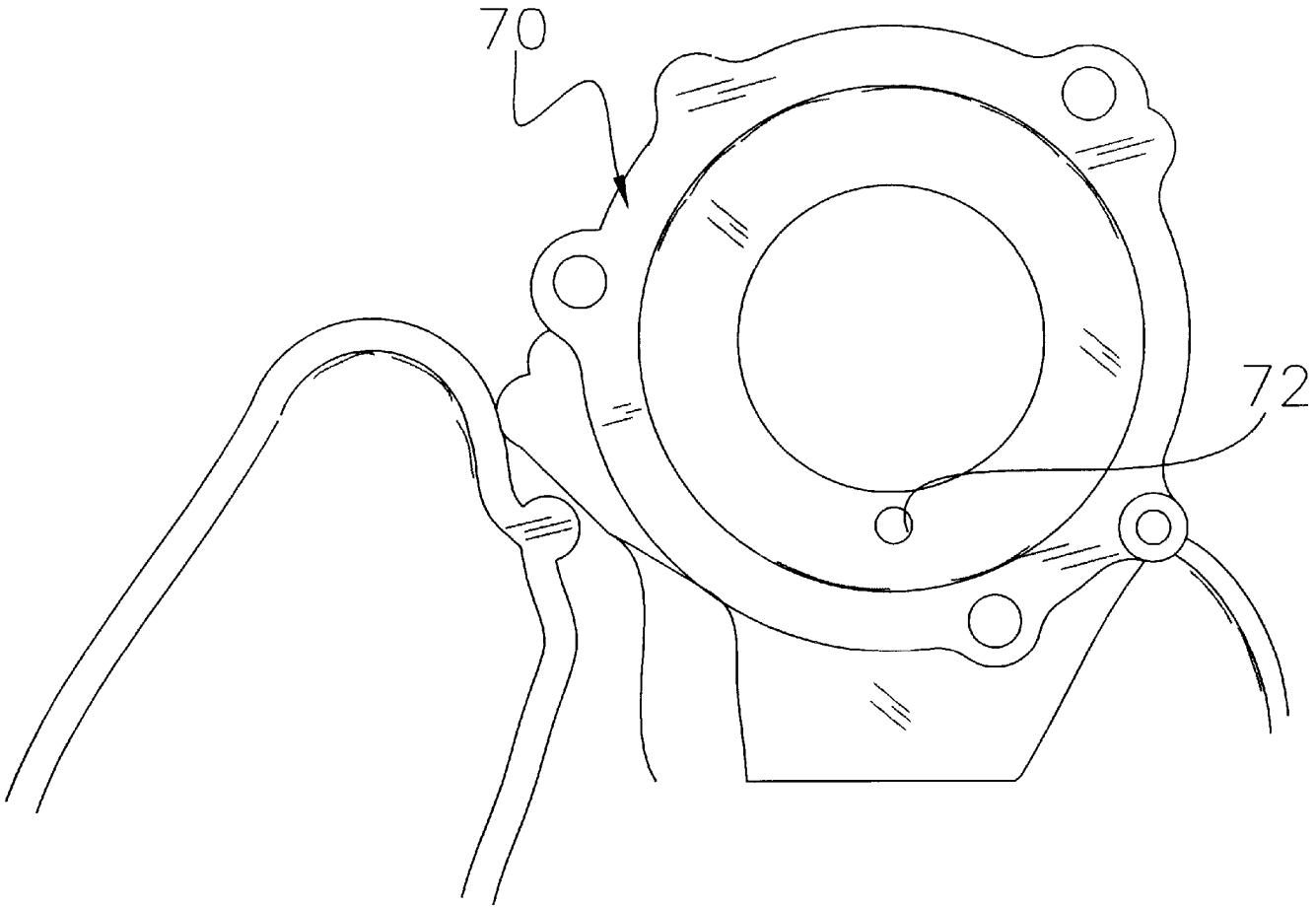
FIG. 6 is a side view of the engine housing.
Figure 7:
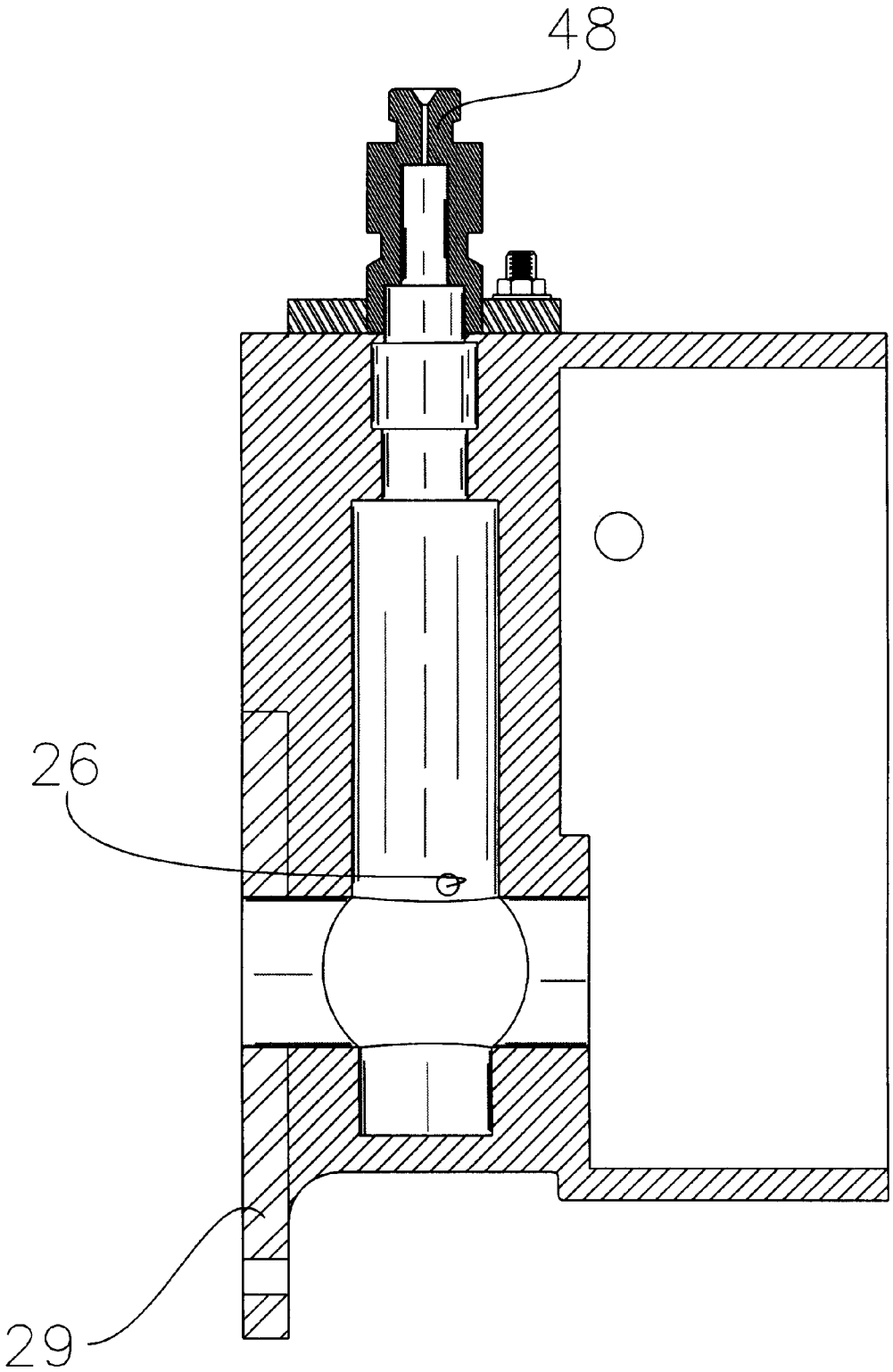
FIG. 7 is a sectional view of the housing of the present invention along line 7—7 of FIG. 3.
Figure 8:
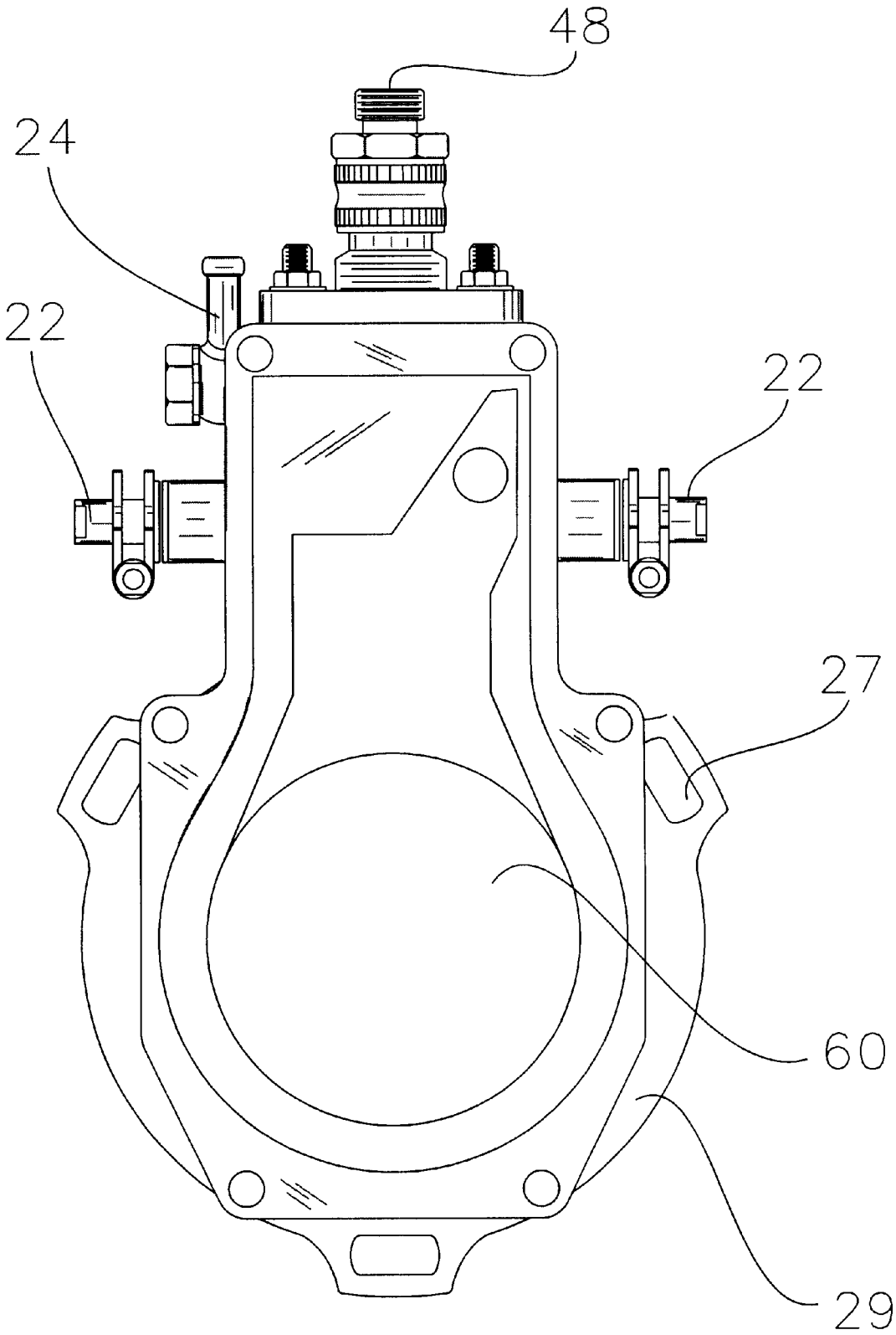
FIG. 8 is a side view of the present invention with the back plate of the housing removed.

The cam lobe 52 is attached to the camshaft 58. As best seen in FIG. 5 when the fuel injection pump system 10 is attached to the engine housing 70 the camshaft is in mechanical connection with first drive gear 54. The camshaft housing 53 includes an aperture 55 to provide fluid connection between the fuel injection pump system 10 and the engine housing 70. As seen in FIG. 6, to facilitate this fluid connection the engine housing 70 should include an engine housing aperture 72 located at a position opposite the aperture 55 on the fuel injection pump system 10.

Figure 11:
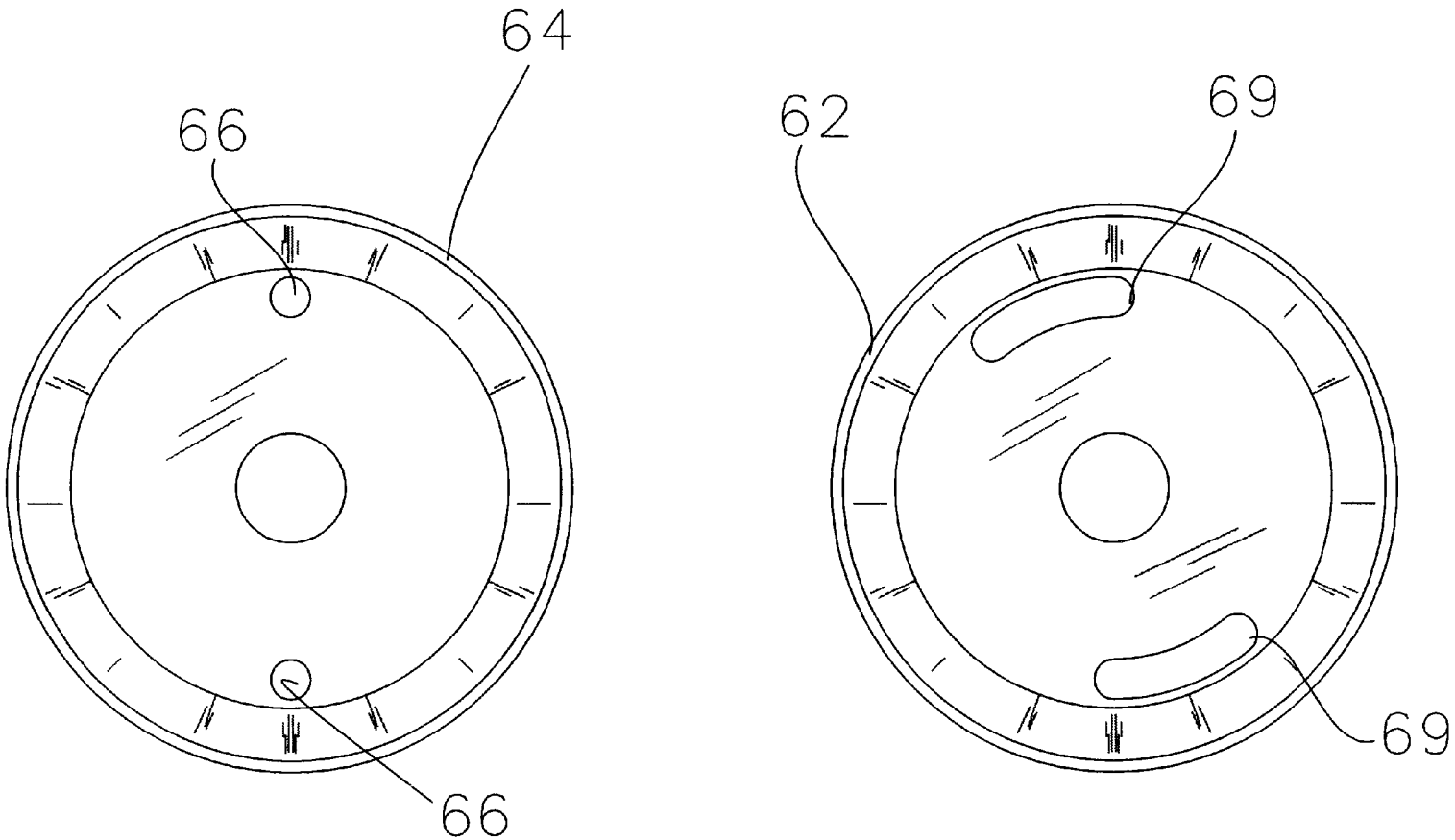
FIG. 11 is a split view of the second embodiment of the present invention.

FIGS. 9 through 11 illustrate a second embodiment of the fuel injection pump system 10. This embodiment includes a modified split housing comprising a first section 62 and a second section 64. Dowels 66 are attached to the first section 62 and are insertable into corresponding adjustment apertures 69 in the second section 64.

In use, the camshaft 58 is rotated in a counterclockwise direction by the first drive gear 54. The cam lobe 52 attached to the camshaft 58 correspondingly rotates in a counter clockwise direction. As the cam lobe 52 rotates against the tappet 32, the tappet 32 moves the plunger 36 towards the retraction delivery valve 42 and against the spring 38. As the plunger 36 travels away from the retraction delivery valve 42 fuel enters the barrel bore 33 through the opening 23 from the fuel inlet 24. As the cam lobe 52 continues to rotate and force the plunger 36 back towards the retraction delivery valve 42 the retraction delivery value 42 is forced against the second spring 44 and fuel is ejected out the nozzle outlet 46.

The amount of fuel which ejects from the nozzle outlet 46 with each pumping stroke of plunger 36 is controlled by the pinion sleeve 31 connected to the fuel delivery control rack 37. Conventional technology is used in metering the amount of fuel.

In operation the fuel metering at idle conditions is controlled by the mechanical governor 60, which using conventional technology provides a steady rate of fuel metering at a designed setting to maintain a smooth rate of idle. As the operator increase the engine speed through utilization of the throttle assembly 22 the governor 60 becomes ineffective as the spring rate of the governor 60 set for idle is surpassed. As the engine speed reaches a predetermined maximum speed the governor 60 is again activated and the fuel rate is reduced by the governor's 60 interaction with the fuel delivery control rack 37. Clearly, idle speed and maximum RPMs can be set by adjustments of the governor 60.

To keep the fuel injection pump system 10 adequately lubricated, oil enters the housing 20 through the oil inlet 26. The location of the oil inlet 26 results in oil being dispersed onto the tappet 32 and cam lobe 52. The oil then travels though the oil outlet aperture 55 in the camshaft housing 53 into the oil inlet aperture 72 in the engine housing 70. The oil is then circulated in the engine housing and eventually returns into the housing 20 through the oil inlet 26. This constant circulation of oil keeps the fuel injection pump system 10 lubricated.

In the second embodiment, the fuel injection pump system 10 includes a two-piece housing that attaches between the mating flange 29 and the engine housing 70. The first section 62 can be rotated and fixed in relation to the second section 64. By turning the first section 62 the cam lobe's 52 position changes in relation to the tappet 32. This adjustment can be used to modify the timing between the plunger 36 sequence and the first drive gear 54. This adjustment may be necessary in using a variety of different fuels.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fuel injection pump system, comprising:

a cam-driven injector pump;

a fuel control rack connected to said cam-driven injector pump;

a mechanical governor attached to said fuel control rack; and a housing that houses said cam-drive injector pump, said fuel control rack, said mechanical governor and includes a fuel inlet and oil inlet.

2. The fuel injection pump system of claim 1, wherein said cam-driven injector pump comprises:

a plunger with a first end and a second end which is helically shaped, wherein said plunger reciprocates axially and turns rotationally in a bore; and a delivery valve in fluid-connection with said bore.

3. The fuel injection pump system of claim 2, wherein said first end of said plunger is exposed to engine lubricating oil.

4. The fuel injection pump system of claim 1, wherein said cam-driven injector pump rotates counter-clockwise.

5. The fuel injection pump system of claim 1 wherein said housing includes a flange for physical connection and fluid connection to an engine housing.

6. The fuel injection pump system of claim 2, wherein said control rack is connected to a pinion sleeve to rotate said plunger.

7. The fuel injection pump system of claim 1, wherein said control rack is connected to a throttle assembly.

8. A fuel injection pump system, comprising:

a cam-driven injector pump;

a fuel control rack connected to said cam-driven injector pump;

a mechanical governor attached to said fuel control rack;

a first housing that houses said cam-drive injector pump, said fuel control rack and said mechanical governor and includes a fuel inlet and oil inlet; and a static timing housing comprising a first side and a second side attached to said first housing.

9. The fuel injection pump system of claim 8, wherein said first side has a dowel insertable into an adjustment slot in said second side.

10. The fuel injection pump system of claim 8, wherein said cam-driven injector pump comprises:

a plunger with a first end and a second end which is helically shaped, wherein said plunger reciprocates axially and turns rotationally in a bore; and a delivery valve in fluid-connection with said bore.

11. The fuel injection pump system of claim 10, wherein said first end of said plunger is exposed to engine lubricating oil.

12. The fuel injection pump system of claim 8, wherein said cam-driven injector pump rotates counter-clockwise.

13. The fuel injection pump system of claim 8, wherein said first housing includes a flange for physical connection and fluid connection to an engine housing.

14. The fuel injection pump system of claim 10, wherein said control rack is connected to a pinion sleeve to rotate said plunger.

15. The fuel injection pump system of claim 8, wherein said control rack is connected to a throttle assembly.

16. The fuel injection pump system of claim 8, wherein said fuel injection pump is attached to a single cylinder compression ignited engine.

* * * * *